US005393157A

United States Patent [19]

Basmajian

[11] Patent Number: 5,393,157

[45] Date of Patent: Feb. 28, 1995

[54] CARD ORGANIZER FOR FILE FOLDERS

[76] Inventor: George A. Basmajian, 1941 S. 371st, Federal Way, Wash. 98371

[21] Appl. No.: 218,252

[22] Filed: Mar. 28, 1994

[51] Int. Cl.[6] ..... B42F 13/00

[52] U.S. Cl. ..... 402/79; 281/38; 206/313; 206/308.3; 40/159

[58] Field of Search ..... 402/79; 281/38; 40/359, 40/159; 206/312, 313, 465, 444; 150/147

[56] References Cited

U.S. PATENT DOCUMENTS

| | | | |
|---|---|---|---|
| 1,048,577 | 12/1912 | Pardoe | 40/359 |
| 2,959,879 | 11/1960 | Mazur | 40/124.4 X |
| 4,008,742 | 2/1977 | Lemler | 150/147 |
| 4,549,658 | 10/1985 | Sfikas | 402/79 |
| 4,850,731 | 7/1989 | Youngs | 402/79 |
| 5,160,296 | 11/1992 | Katz | 40/359 X |
| 5,263,523 | 11/1993 | Scheunemann | 150/147 X |

*Primary Examiner*—Willmon Fridie
*Attorney, Agent, or Firm*—David L. Tingey

[57] ABSTRACT

A card organizer for attaching cards such as business cards or computer disks to an office file folder has a flat single page holder with a plurality of pockets aligned vertically. Each pocket is constructed with a front and a back sheet, the front sheet having a plurality of horizontal rectangular slots to allow insertion of objects of extended width. The back sheet has a like number of arched tabs corresponding to the front sheet slots partially cut on the back sheet smaller in width than the corresponding slot on the front sheet, leaving the tab bottom attached to the rear sheet to form a bend line. The top of the tab is attached to the front sheet under a slot thereby forming a pocket with a pinching action between the tab and the back sheet. Tape on the back sheet is used to attach the holder to a file folder.

5 Claims, 2 Drawing Sheets

CARD ORGANIZER FOR FILE FOLDERS

BACKGROUND OF THE INVENTION

The present invention relates to business card organizers and more particularly to card holders that removably attach cards and the like to file folders.

It is known in the art to have business card organizers of various kinds. It is also known to have photograph folios that hold a number of photographs, credit cards or business cards. Commonly, the cards are arranged in the folios or other holders in side-by-side pockets or in overlapping pockets. It is also common to have single jackets for computer disks.

None of the previous business card holders are suitable for attachment to a file folder for a user that wants the file to be as thin as possible, able to hold a plurality of cards in a nonoverlapping arrangement, and grasp the cards in the holder pocket to resist the cards from falling out of the pockets. Overlapping cards or computer disks thicken the file unnecessarily. It is also difficult to quickly remove a card from folios having a number of pockets where the card or picture is fully contained within the pocket, such as in a photograph album folio. Therefore, it is the object of this invention to have a holder that arranges business cards and the like, such as computer disks, in nonoverlapping format with part of the business card exposed for ease in grasping and removing the card. It is a further object of the invention to have a card organizer with pockets that are designed to secure the card in the pockets while still providing easy access and card removal.

SUMMARY OF THE INVENTION

The card organizer of this invention contemplates a flat single page holder with a plurality of pockets sized less than that of the card to be held in the pocket, such as business cards or computer disks. The pockets are arranged such that the cards when in the pockets of the holder do not overlap so that the holder remains flat and as thin as practical. The holder is also provided with a means of attaching it to a file folder, such as tape on the back of the holder. In this way, a file can be maintained with associated business cards held in a holder which is itself attached to the file folder.

The holder is constructed with a front and a back sheet. The front sheet has a plurality of horizontal slots, preferably spaced apart vertically. The back sheet has a like number of tabs partially cut on the back sheet smaller in width than the slot on the front sheet, leaving the tab bottom attached to the rear sheet. Each tab extends from the tab bottom to the the front sheet below a corresponding front sheet slot a vertical distance less than the height of a card for which it is designed to hold. The top of the tab is attached to the front sheet under the corresponding front slot forming a pocket between the tab and the rear sheet narrowing from the slot to the tab bottom such that at the tab bottom, a card placed therein is retained in the pocket by pinching bias action of the tab against the back sheet increasing as the pocket narrows to the tab bottom.

The tape may include a mildly-adhering cover over tape adhesive to protect the tape prior to use, referred to as "strip off tape".

Thus, in use, the holder attached to a file folder by pealing the protective cover of the strip off tape from the rear sheet and attaching it to the folder. A card is inserted into a slot in the front sheet and urged to the bottom of the tab into the pinching action of the pocket with the card remaining partially out of the slot.

DESCRIPTION OF THE PREFERRED EMBODIMENTS

Figure 1:
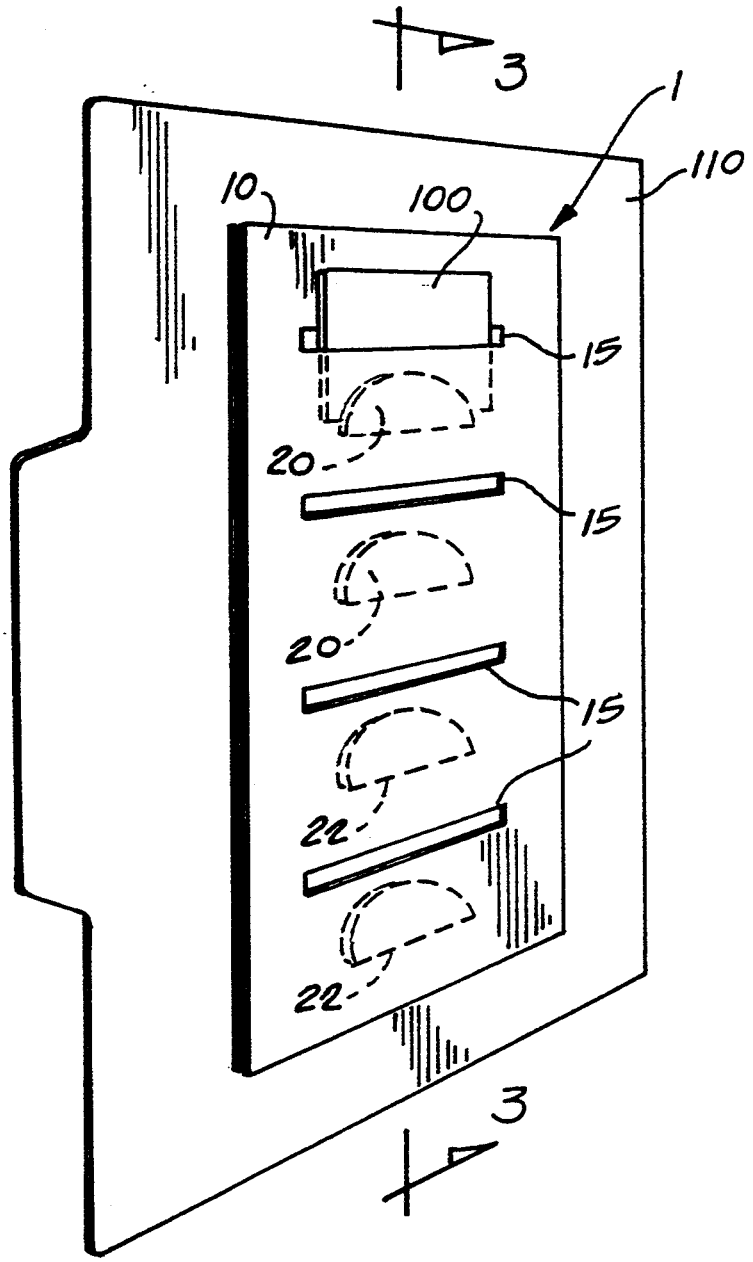
FIG. 1 is a front prospective view of a card organizer attached to a file folder.
Figure 2:
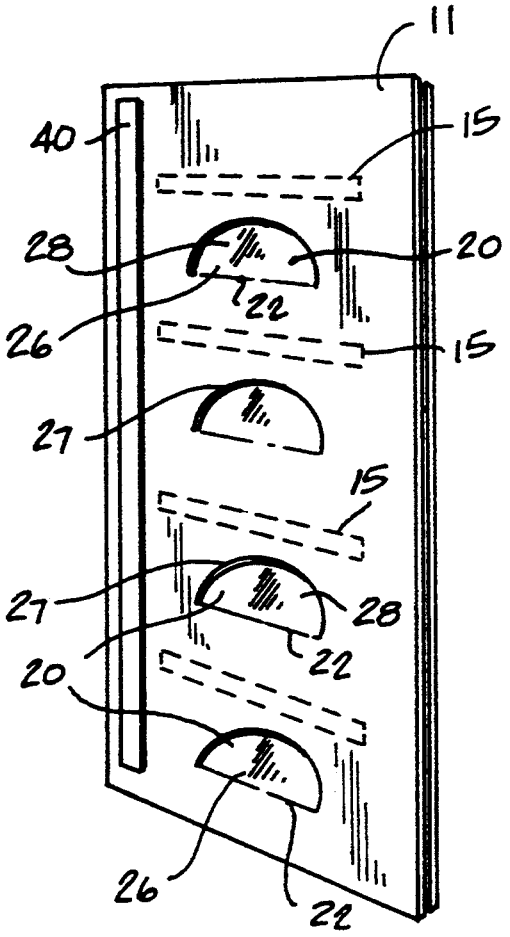
FIG. 2 is a back prospective view of a card organizer showing tabs extending inward of its back to its front where it is attached forming a pocket therein.

The flat, single page card organizer 1 of the present invention has a plurality of pockets 12 sized less than that of a card 100 intended to be held in the pocket 12 such that the cards 100 do not overlap when in the pockets 12 of the organizer 1.

Figure 3:
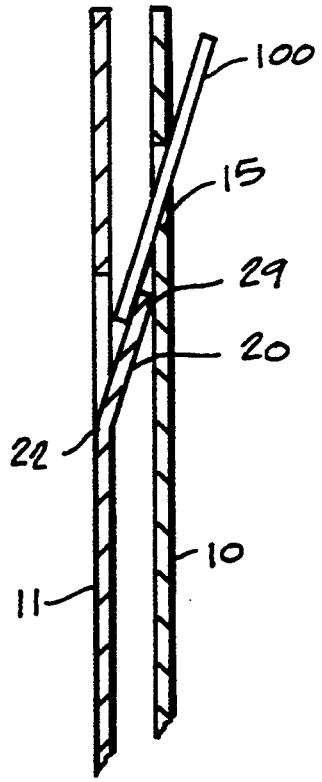
FIG. 3 is a sectional view of a card organizer showing a front and a back organizer sheet with a tab extending therebetween to form a pocket.

The organizer 1 comprises a front sheet 10 with a plurality of horizontal slots 15 spaced apart vertically and a back sheet 11 in parallel face to face orientation as shown in FIG. 3. Each slot 15 is an oblong or rectangular hole rather than simply a slit, which hole allows for a card 100 of extended thickness, such as a computer disk, particularly a 3.5-inch style disk of about ⅛-inch depth. The back sheet 11 has a plurality of tabs 20 each corresponding to a front sheet slot 15. Each tab 20 is formed with a cut 27 on the back sheet 11 into an arched upper section 28 with a bottom 26 forming a bend line 22 in connection with the back sheet 11. The tab bottom 26 is smaller in width than the slot 15 on the front sheet 20 so that a card 100 fit into the slot 15 is supported intermediate its width by the tab bottom 26. The tab upper section 28 of the back sheet 11 is attached to the front sheet 10 at a position 29 under a corresponding slot 15 forming a pocket 12 between the tab 20 and the back sheet 11 therein attaching the front sheet 10 to the back sheet 11. Each tab bend line 22 is a distance from the corresponding front sheet slot 15 a vertical distance less than the height of a card 100 which the organizer 1 is designed to hold.

The organizer 1 is also provided with a means of attaching it to a file folder 110, such as strip off tape 40 on the back of the organizer 1.

To provide a plurality of pockets on the same organizer without overlapping the pockets to minimize the thickness of the organizer with its card contents for use in a file folder, a plurality of pockets are aligned in a vertical relation with a first pocket above and adjacent to a second pocket with the arch of a tab of a first pocket attached above the slot of the lower adjacent second pocket and with the tab bend line of the first pocket also above the slot of the lower adjacent second pocket of a lower adjacent pocket and with the tab bend line also above the slot of the lower adjacent pocket.

The embodiment described is preferred but is not meant to limit the scope of the present invention. All equivalent embodiments are intended to be included herein. For example, the shape of the tab need not be arched necessarily, but need only have a bottom width less than that of the slot.

Having described the invention, what is claimed is:

1. A flat, single page card organizer for attaching to a traditional file folder, the organizer having a pocket for holding a card, such as a business card or a computer disk, comprising a front sheet with a horizontal rectangular slot sized such that a card of extended depth may pass therethrough, a back sheet in parallel face to face orientation to the front sheet, an arched tab on the back sheet with a bottom forming a bend line in connection with the back sheet, the tab bottom being smaller in width than the front sheet slot, with the tab arch attached to the front sheet below the front sheet slot forming a pocket thereby attaching the front sheet to the back sheet.

2. The card organizer of claim 1 further comprising a plurality of pockets aligned in a vertical relation with a first pocket above and adjacent to a second pocket with the arch of tab of a first pocket attached above the slot of the lower adjacent pocket.

3. The card organizer of claim 1 further comprising a plurality of pockets aligned in a vertical relation with a first pocket above and adjacent to a second pocket with the bend line of the first pocket of a tab above the slot of the lower adjacent second pocket such that the pockets do not overlap.

4. The card organizer of claim 1 further comprising means of attaching it to a file folder.

5. The card organizer of claim 4 wherein the means of attaching it to a file folder is tape on the back of the organizer.

* * * * *